United States Patent [19]

Stockton et al.

[11] 4,302,734

[45] Nov. 24, 1981

[54] MICROWAVE SWITCHING POWER DIVIDER

[76] Inventors: Robert A. Frosch, Administrator of the National Aeronautics and Space Administration, with respect to an invention of Ronald J. Stockton, Nederland; Russell W. Johnson, Boulder, both of Colo.

[21] Appl. No.: 129,793

[22] Filed: Mar. 12, 1980

[51] Int. Cl.[3] ..... H01P 1/15

[52] U.S. Cl. ..... 333/104; 333/246

[58] Field of Search ..... 333/101, 103, 104

[56] References Cited

U.S. PATENT DOCUMENTS

| | | | |
|---|---|---|---|
| 2,913,686 | 11/1959 | Fubini et al. | 333/238 |
| 3,223,947 | 12/1965 | Clar | 333/104 |
| 3,474,358 | 10/1969 | Geddry et al. | 333/103 |
| 3,475,700 | 10/1969 | Ertel | 333/104 |
| 3,503,014 | 3/1970 | Hall et al. | 333/104 |
| 4,127,830 | 11/1978 | Chalifour et al. | 333/104 |

*Primary Examiner*—Paul L. Gensler

*Attorney, Agent, or Firm*—Ronald F. Sandler; John R. Manning; John O. Tresansky

[57] ABSTRACT

A microwave switching power divider for selectively dividing and switching microwave energy among a plurality of outputs to other microwave devices includes a pair of parallel, spaced-apart circular ground planes defining a microwave cavity with multi-port microwave power distributing switching circuitry formed on opposite sides of a thin circular dielectric substrate disposed beween the ground planes. The power distributing circuitry includes a conductive disk located at the center of the substrate and connected to a source of microwave energy. A plurality of tapered radial power dividing transmission lines for intercepting the standing waves are symmetrically disposed about and connected to the conductive disk. Within each line, a high speed, low insertion loss switching diode and a DC blocking capacitor are connected in series between the outer end of a transmission line and an output port. A high impedance, microwave blocking DC bias choke is connected between each switching diode and a source of switching current. The switching source forward biases the diodes to couple microwave energy from the conductive disk to selected output ports and, to associated antenna elements connected to the output ports to form a synthesized antenna pattern. Output port impedance is held within a desired range by choice of cavity and power distribution circuitry dimensions.

14 Claims, 7 Drawing Figures

Fig. 1
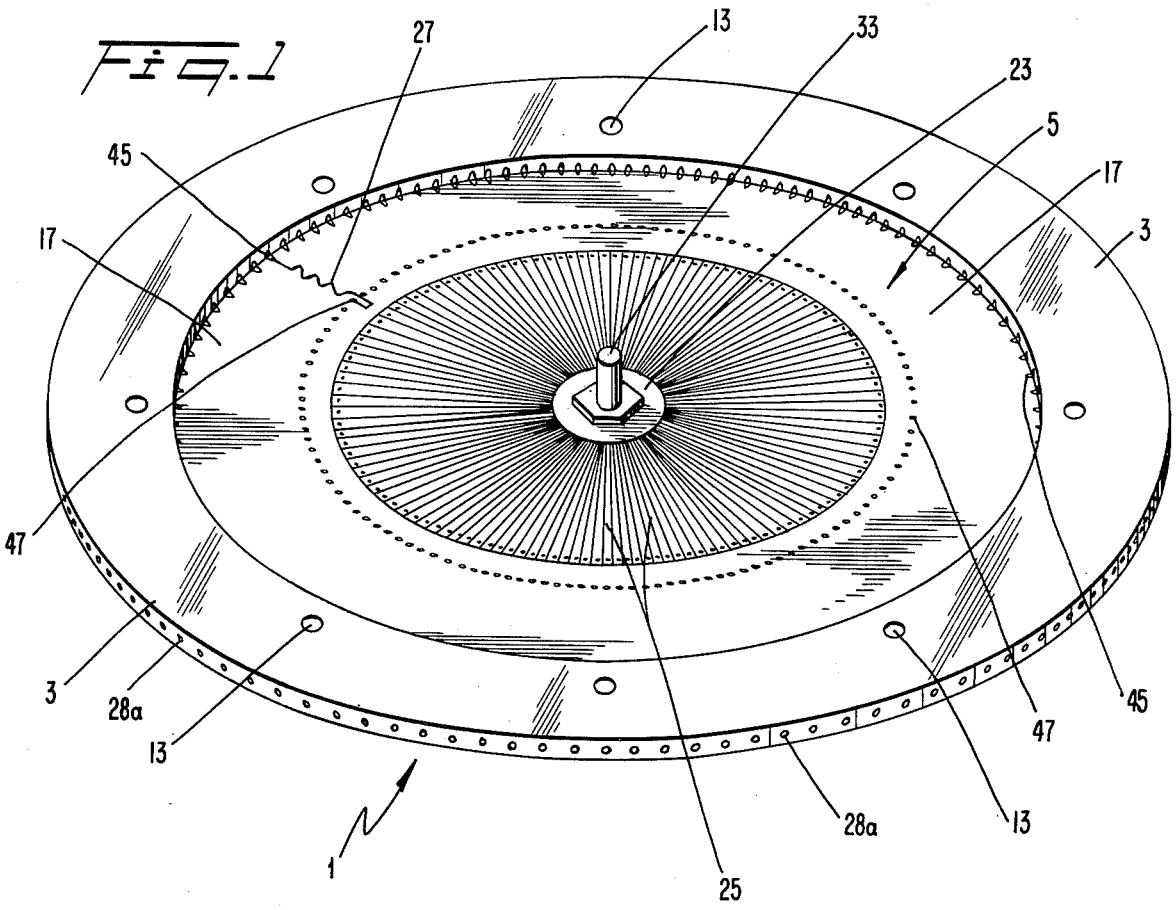
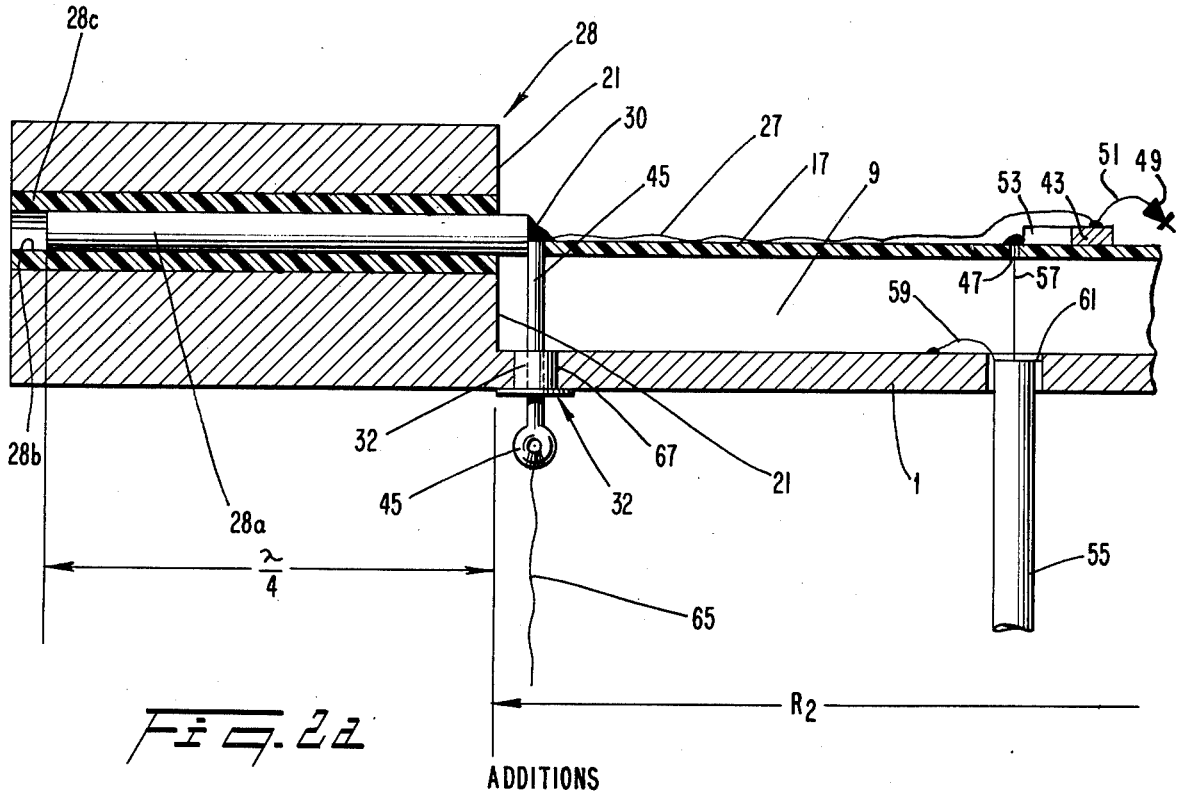
Fig. 2a

MICROWAVE SWITCHING POWER DIVIDER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457), and may be manufactured and used by or for the Government for governmental purposes without the payment of any royalties thereon or therefor.

BACKGROUND OF THE INVENTION

The invention relates to the field of microwave switches, and more particularly to a microwave switching power divider for selectively dividing and switching microwave energy between a source of microwave power and a plurality of microwave devices such as antenna elements.

Modern microwave antenna systems, such as those used in multi-element spherical arrays and satellites, are characterized in that a single source of microwave energy is selectively coupled to one or more of the antenna elements at the same time to perform a beam forming function. Each actuated element must be fed with microwave energy having substantially equal amplitudes and uniform phase, regardless of the number of elements so actuated. Otherwise, power transfer to the antenna elements is inefficient.

Conventional multi-element microwave power dividing and switching devices utilize a power divider to distribute the microwave energy to a group of microwave devices such as an array of antenna elements, and a plurality of single-pole multi-throw switches, one for each group of elements, to select one of the antenna elements of the group as the output element. Diode switching devices have been used to replace conventional coaxial cable multi-pole switches to reduce insertion losses associated with these mechanical switches.

Such prior art antenna switching devices are limited in beam-forming performance, because it is often necessary to actuate two or more antenna elements within a particular group of elements to form a desired beam pattern. In addition, large numbers of switches and interconnecting cables are used in such devices resulting in increased insertion losses and decreased output power and efficiency. The complexity and bulk of conventional microwave power dividing and switching devices preclude their use in satellite systems where weight and size must be minimized.

SUMMARY OF THE INVENTION

It is therefore a primary object of the present invention to provide a microwave switching power divider for efficiently dividing and rapidly switching microwave energy between a source of microwave energy and one or more microwave devices.

It is a further object to provide a microwave switching power divider having a low insertion loss between a microwave input source and one or more microwave devices.

It is another object to provide a microwave switching power divider capable of delivering microwave energy from a microwave input source to one or more microwave devices with substantially equal phase and amplitude.

It is still another object to provide a microwave switching power divider capable of high-order mode suppression.

It is yet a further object to provide a microwave switching power divider which is light in weight and small in size.

It is a still further object to provide a microwave switching power divider for switching microwave energy between a source of microwave energy and one or more antenna elements.

These and other objects are achieved by the present invention wherein there is provided a microwave switching power divider, having a pair of parallel ground planes defining a microwave cavity and microwave power distributing and switching circuits formed on a thin dielectric substrate disposed midway between the ground planes for selectively dividing and switching microwave energy among a plurality of microwave devices, such as antenna elements.

The power distribution circuits include a power distribution element disposed about the center of the substrate and connected to a source of microwave energy, and a plurality of radial power dividing transmission lines for intercepting standing waves propagating in the cavity. The transmission lines are symmetrically disposed about, and connected to, the conductive disk. A plurality of output ports are formed on the dielectric substrate with one port disposed adjacent each said radial transmission line. Each output port is connected to a separate microwave device.

Switching means is connected to each transmission line and an adjacent output port to selectively couple one or more of the radial transmission lines to the microwave devices.

The microwave switching power divider of the present invention is desirably light in weight and small in size, thus enabling it to be used in environments, such as earth orbiting satellites, where bulkier coaxial switching arrangements are impractical. Microprocessor control can be used to rapidly select and actuate one or more of the switching means. The integrated arrangement of the microwave cavity and the power distribution and transmission circuitry formed on the dielectric substrate enables a plurality of the output ports to be simultaneously coupled to the source of microwave energy without causing substantial switch insertion losses or switch input/output impedance mismatches.

The switching power divider of the present invention is particularly useful for coupling microwave energy to selected groups of antenna elements in a multi-element spherical antenna array. A utilizer of microwave energy, such as a microwave receiver, can be substituted for the microwave energy source when it is desired to use a multi-element antenna array for receiving microwave signals.

BRIEF DESCRIPTION OF THE INVENTION

These and other features and advantages are presented in the following detailed description of the invention taken in conjunction with the following drawing figures, wherein:

FIG. 1 is a perspective view of the microwave switching power divider shown with the upper ground plane removed;

Figure 2:
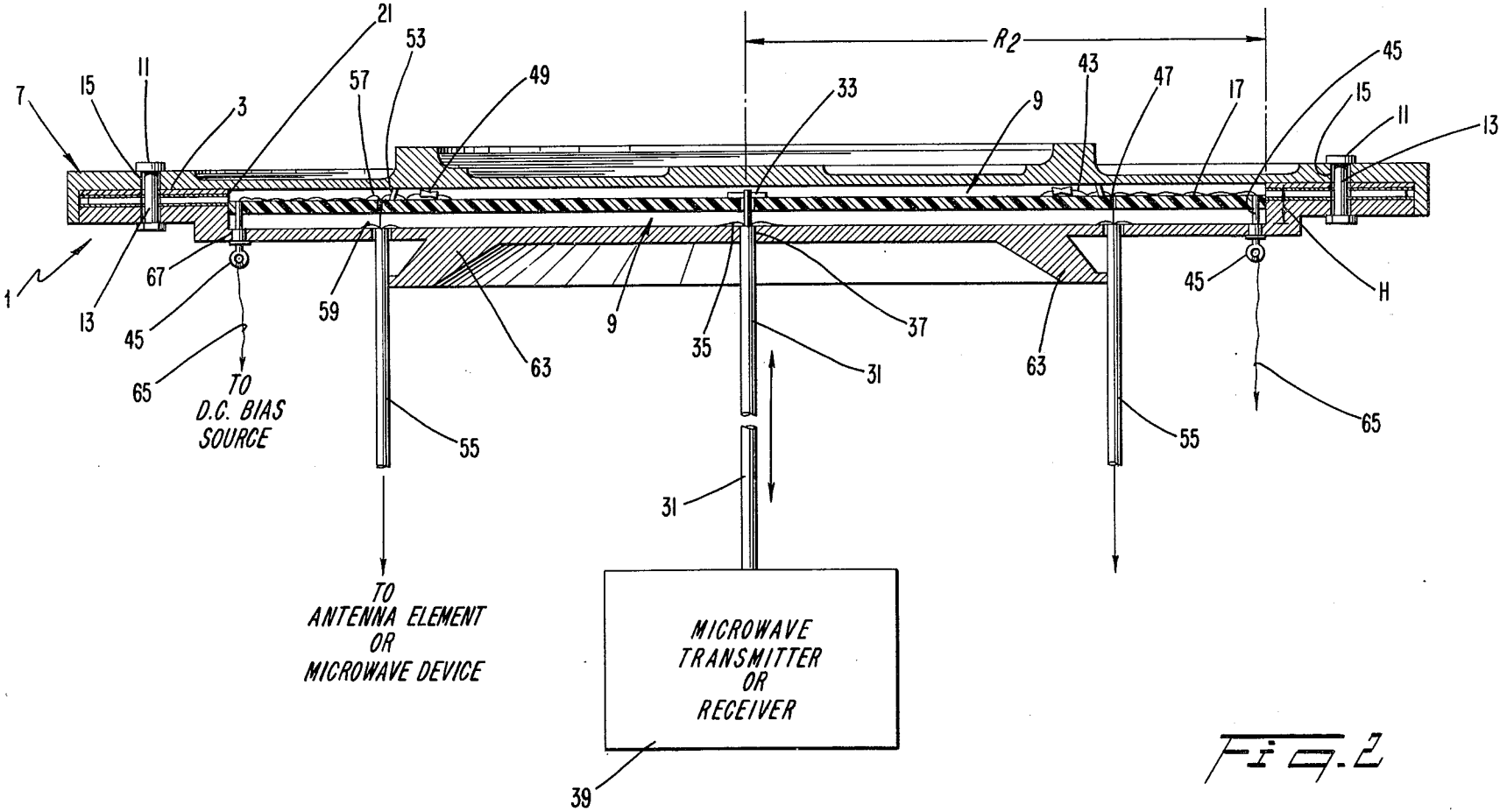
FIG. 2 is a cross-sectional view of the assembled microwave switching power divider (including upper ground plane) of FIG. 1.
Figure 3:
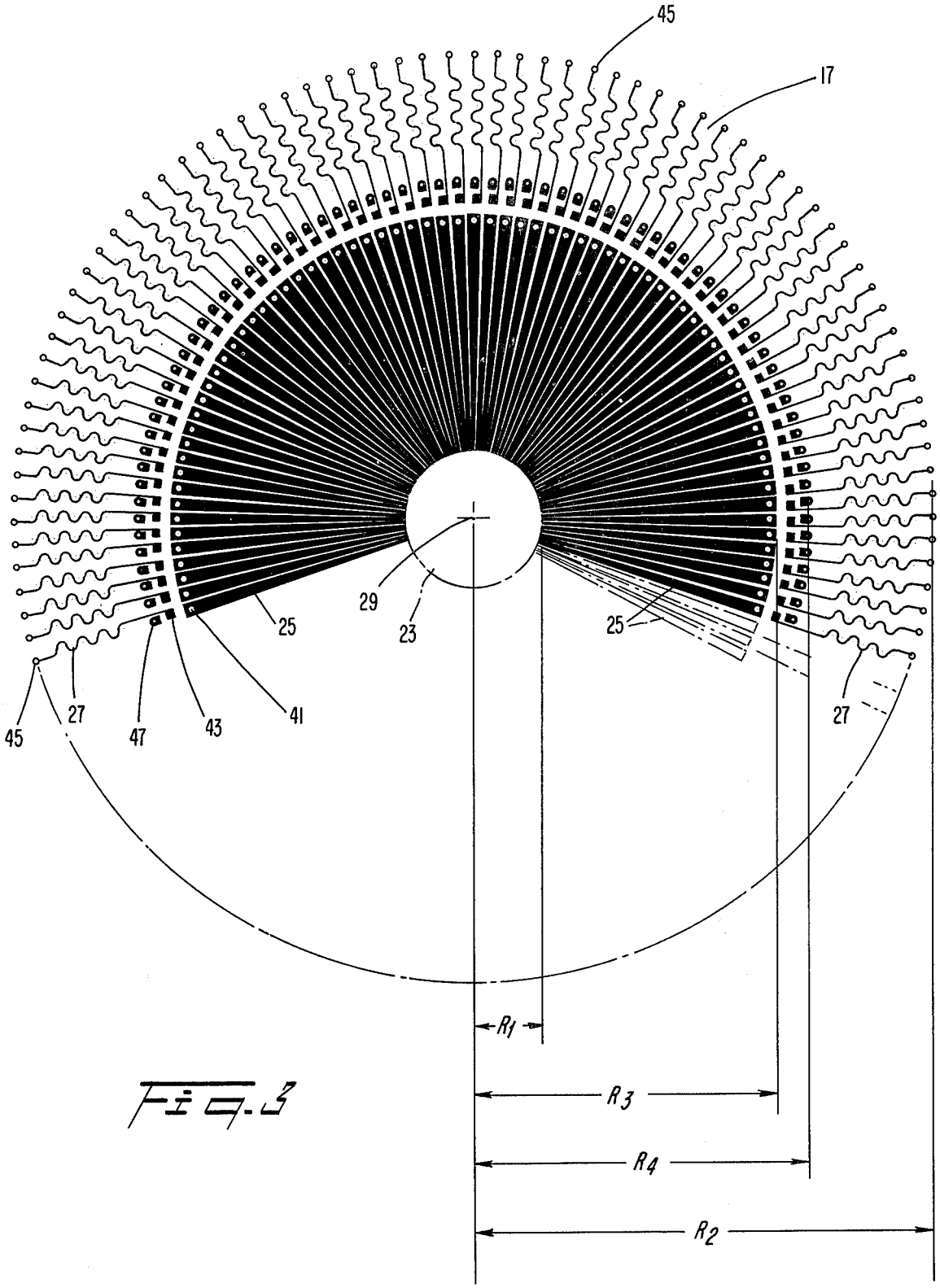
Figure 5:
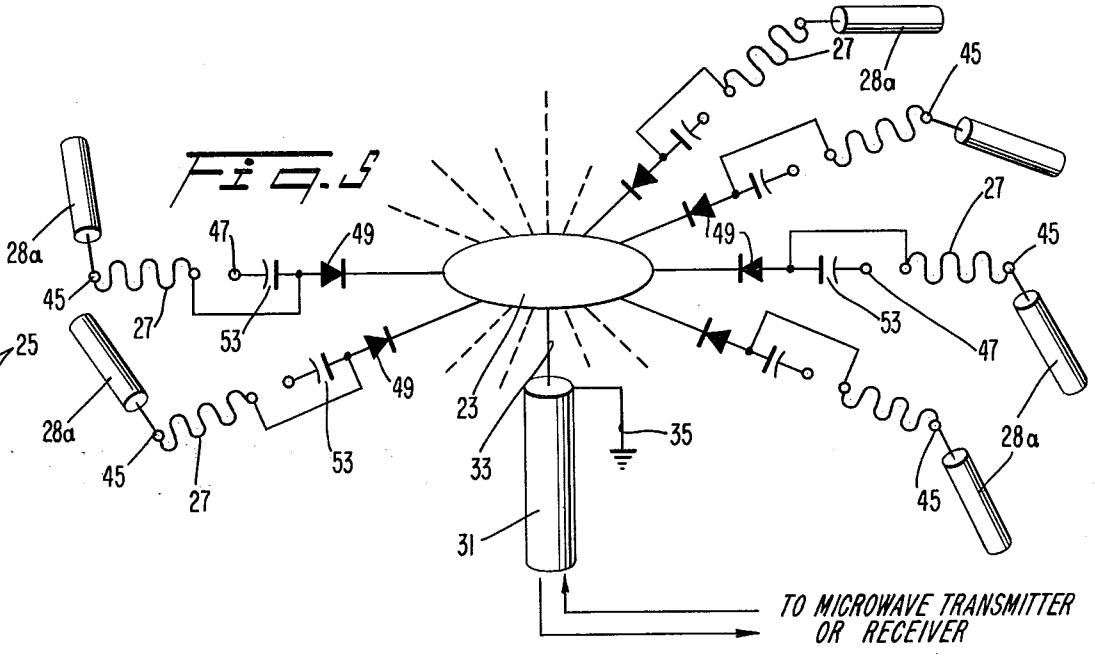
Figure 6:
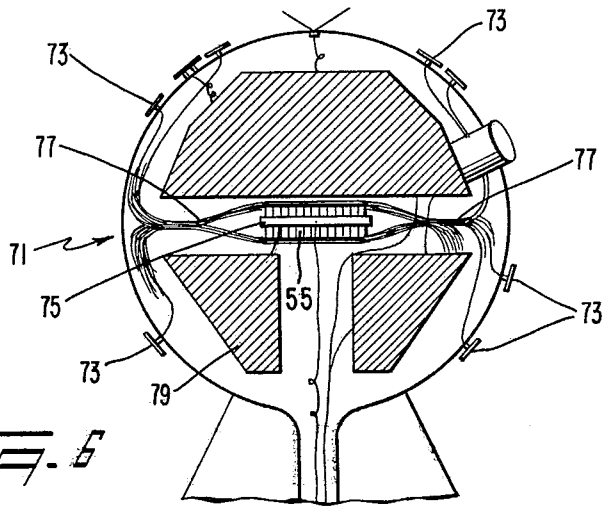
Figure 4:
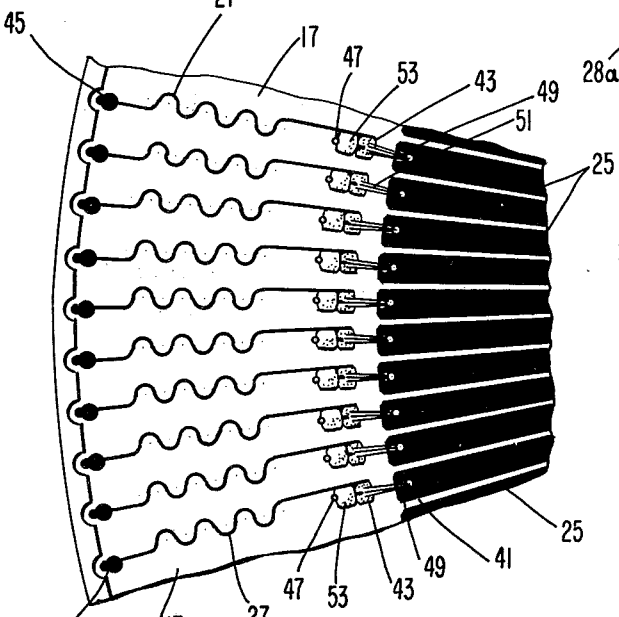

FIG. 2*a* is a detailed view of an end portion of the power divider shown in FIG. 2;

FIG. 3 is a partial plan view of a 210° sector of one side of the dielectric substrate shown in FIG. 1, illustrating the arrangement of power distribution and transmission circuitry formed thereon;

FIG. 4 is a detailed view of a section of the power dividing and switching circuitry of the present invention;

FIG. 5 is a schematic view of the power dividing and switching circuitry of FIGS. 1 and 4; and FIG. 6 is a cross-sectional view of the power divider switch of FIG. 1 for use in a satellite having a spherical antenna array.

DETAILED DESCRIPTION OF THE PREFERRED EMBODIMENT

The microwave switching power divider of the present invention, as shown in FIGS. 1 and 2, includes a first circular ground plane member 1 having an annular flange 3 and a central recessed area 5 formed in ground plane 1. A second circular ground plane member 7 (FIG. 2) fits flush over ground plane 1 along flange 3 to form a microwave cavity 9. Ground plane or lid 7 is secured to ground plane 1 by a number of bolts 11 disposed through openings 13 and 15 formed respectively through flange 3 and lid 7. Ground planes 1 and 7 are formed from a conductive metal such as aluminum. The portions of ground planes 1 and 7 which define cavity 9 are overcoated with a thin (0.0005") coating of copper for good conductivity.

A dielectric substrate 17, having a number of microwave power dividing and switching circuits formed thereon, is secured midway between ground planes 1 and 7 by electrically conductive terminals 45 (see FIG. 2*a*) around wall 21 which defines the inner periphery of recessed area 5. The power dividing circuitry on dielectric substrate 17 comprises a conductive foil pattern, shown in FIG. 3, which may be photoetched or otherwise formed on either one or both sides of the substrate. Dark areas in FIG. 3 indicate conductive circuitry which is preferably formed from copper foil using conventional printed circuit board techniques.

Identical, aligned foil patterns are applied to both sides of substrate 17 to provide mechanical stability for the thin dielectric substrate and the foil patterns. The arrangement of foil patterns on both sides of dielectric substrate 17 also ensures electrical symmetry between the fields propagating through the foil patterns. The power distribution and transmission circuits disposed on both sides of substrate 17 are connected by a number of plated through-holes formed in the dielectric substrate, thereby ensuring the formation of equipotential surfaces on both sides of the dielectric to eliminate electric fields which might otherwise tend to form between the conductive circuitry in the dielectric material. The dielectric substrate is relatively thin (approximately 0.005") and formed from a low dissipation material, such as fiberglass, to prevent dielectric loading of the cavity. For optimum efficiency, dielectric substrate 17 consumes less than 5% (typically 2%) of cavity 9 by volume.

The conductive pattern includes a central power distribution element or disk 23 formed about the center of substrate 17, and a plurality of identical radial microwave transmission lines 25 connected to and symmetrically disposed about conductive disk 23. A microwave blocking choke in the form of a series one-quarter wavelength high impedance meander line 27 and a shunt ¼ wavelength stub 28 is formed radially outward from each transmission line 25. Referring to FIG. 2*a*, each shunt stub 28 is a radial coaxial line comprising a conductor 28*a* extending outwardly from meander line 27 within aperture 28*b* formed radially in ground plane 1 in line with a corresponding transmission line 25. An insulating tube 28*c* formed of Teflon or other dielectric insulates the conductor 28*a* from the ground plane 1 and centers the conductor within the aperture 28*b*. The body of ground plane 1 forms the outer conductor of stub 28. The inner conductor 28*a*, meander line 27 and control terminal 45 are soldered together at 30.

Disk 23 has an input terminal or opening 29 formed at the center thereof for connection to a conventional coaxial cable 31, as shown in FIG. 2. Cable 31 has a center conductor 33 disposed through conductive plated-through-opening 29 and attached at one end to disk 23 as well as a shield 35 connected to ground plane 7. The opposite end of cable 31 is routed through opening 37 formed in ground plane 7 and is connected to a source of microwave energy 39.

Each radial transmission line 25, which is constructed in accordance with conventional microwave stripline techniques, is formed with a taper whose width increases with radial distance from disk 23. The outermost portion of each transmission line includes a plated-through-opening 41. A conductive land 43 (FIGS. 3 and 4) is formed at the radially inward end of each meander line 27 opposite opening 41 of transmission line 25. A DC bias connection comprising a plated-through-opening or terminal 45 is formed at the radially outermost portion of each meander line 27. A conductive output port comprising a plated-through-opening 47 is formed slightly radially outwardly from each land 43.

As shown in the detailed view of FIG. 4 and schematic view of FIG. 5, a high speed microwave switching diode 49 is connected between tapered transmission line 25 and land 43 by a pair of conductive wires or ribbons 51 (FIG. 4). A pair of conductive ribbons (such as gold ribbons) rather than a single ribbon are used to reduce inductance at microwave frequencies. A source of DC bias (not shown) is connected to feed through terminal 45 of meander line 27 by a cable 65 disposed through opening 67 formed in ground plane 1. The terminal 45 is insulated from ground plane 1 by conventional glass feed-through 32. The terminal 45, besides carrying DC control bias, also supports the dielectric substrate 17 within cavity 9, as discussed above.

Diode 49 preferably is a PIN switching diode actuated by the DC bias applied at terminal 45 through meander line 27. One-quarter wavelength meander line 27 presents a high impedance to microwaves propagating within cavity 9 and prevents the microwaves from flowing into DC bias cables 65. The return path of DC bias is through a connection (not shown) to conductive disk 23.

A capacitor 53 is connected between each land 43 and its associated output port 47. The capacitors 53 prevent DC bias supplied to diodes 49 via meander lines 27 from flowing into output ports 47.

A coaxial cable 55 (FIG. 2) has a center conductor 57 connected at one end to output port 47 and a shield 59 connected to ground plane 1. Each cable 55 is routed through an opening 61 formed in ground plane 1 and opening 47 in substrate 17. A plurality of brackets 63, formed as part of ground plane 1, support cables 55. The opposite end of each cable 55 is connected, as illustrated, to one antenna element of a multi-element antenna array.

The arrangement and dimensions of cavity 9, ground planes 1 and 7, and the conductive power distribution circuitry formed on dielectric substrate 17 depend on several factors. The total number of microwave devices to be accommodated by associated output ports 47 places a lower limit on the radius of conductive disk 23 and transmission lines 27. Disk 23 must be large enough to terminate the required number of transmission lines at a reasonable width for electrical continuity and manufacturing reliability. However, the disk cannot be made too large without introducing undesirably high values of parasitic shunt capacitance with respect to the ground planes which would make impedance matching difficult. For a large number of output ports, such as the 120-port device shown in FIGS. 1 and 3, a central disk radius $R_1$ of 0.09 wavelength accommodates the required number of transmission lines and output ports without introducing undesirably high values of parasitic shunt capacitance.

The dimensions of cavity 9 are dependent on the design frequency of the switching power divider and the desired standing wave pattern to be produced within the cavity. The radius $R_2$ (FIG. 2) of cavity 9 is important since the short circuit boundary between ground planes 1 and 7 (i.e., vertical wall 21 of cavity 9) determines the standing wave pattern of microwaves propagating within cavity 9. For propagation in a desired TEM (transverse electromagnetic wave) mode, a cavity height H (FIG. 2) of approximately 0.05 to 0.1 wavelength and a cavity radius $R_2$ of approximately 0.6 wavelength are preferred. The cavity height is preferably small in terms of wavelength to prevent higher order modes from propagating in the axial or "Z" directions. The ground plane spacing, however, is large enough to achieve reasonable power levels at a useful impedance range for the transmission line circuits formed on substrate 17.

The arrangement of dielectric substrate 17 and the circuits formed thereon, midway between ground planes 1 and 7 within cavity 9, results in air-loading of the dielectric substrate circuitry within the enclosed cavity. Air-loading of the circuitry at microwave frequencies allows high-power levels to be achieved within the cavity with relatively low transmission line losses.

The radius $R_4$ to output ports 47 (FIG. 3) and the radius $R_3$ of each associated radial transmission line 25 are dependent on two factors. First, the output port radius $R_4$ must be large enough so that the circumference of the circle so defined is large enough to physically accommodate the number of output ports 47 and associated coaxial cables 55. Second, the location of output ports 47 with respect to central microwave input 29 and cavity short-circuit boundary 21 determines the impedance level of the output ports.

For the 120 output port assembly described above, an output port radius $R_4$ of 0.435 wavelength results in a useful output port impedance range of approximately 50–100 ohms. Each output port 47 is thus located approximately 0.15 to 0.2 wavelength radially inward from cavity boundary 21. The 0.15 to 0.2 wavelength radial distance between the cavity radius $R_2$ and the output port radius $R_4$ also accomodates one-quarter wavelength meander lines 27.

The basic function of the switching power divider of the present invention is to efficiently transfer microwave input energy from input 29 to all active (switched "ON") output ports 47. Microwave energy applied to input 29 excites a TEM radial line mode between ground planes 1 and 7. The field lines of standing waves propagating in cavity 9 are intercepted by radial strip line-type transmission lines 25 to transfer microwave energy to selected output ports 47 through switching diodes 49. It is desirable for most efficient energy transfer through the switching power divider that the impedance level of the input 29 and output ports 47 be properly matched. The output impedance of the active output ports 47 is dependent on the output port radius $R_4$ and the width of the tapered transmission lines 25, for a fixed cavity radius $R_2$. The output impedance level is transformed back to input 29 with the impedance transformation dependent on the taper and the length or radius $R_3$ of transmission lines 25.

The nearly open circuit condition for the "OFF" output ports is transformed back to input 29 with approximately the same transformation ratio as associated with the "ON" output ports. The resultant input impedance is equal to the parallel combination of the transformed output impedance for the "ON" ports and the "OFF" output ports, where the number of "ON" and "OFF" ports equals the total number of output ports. A transmission line outer radius $R_3$ of 0.4 wavelength provides a 50 to 100 ohm output impedance match to a 100 ohm input when up to 10% of the output ports are actuated into their "ON" state (i.e. 12 output ports in the case of the 120 output port device described). If a greater number of "ON" output ports must be simultaneously accommodated, an input impedance matching network may be necessary.

The approximately 0.0175 wavelength difference between transmission line outer radius $R_3$ and output port radius $R_4$ accommodates the mounting of diodes 49 and capacitors 53 in series between each transmission line 25 and associated output port 47. Diodes 49 are mounted as close as possible to output port 47 to reduce coupling to the cavity field and thereby improve the isolation of an output port when in its "OFF" state.

For efficient transfer of microwave energy from input 29 to output port 47, low insertion loss (approximately 0.8 dB) PIN switching diodes 49 are preferred. Such diodes possess desirable high speed switching characteristics (switching speed of approximately 1 microsecond). Each switching diode 49 acts as the electronic equivalent of a single pole-single throw (SPST) on-off switch placed in series between the microwave input 29 and output ports 47.

The switching action of diodes 49 is controlled by DC bias applied along meander lines 27 from bias connections 45. A forward bias of approximately 25 milliamps at 900 millivolts voltage drop across each diode switches the diode into its conducting or "ON" state. A reverse bias of approximately −20 volts with respect to ground is sufficient to place a selected diode in its non-conducting or "OFF" state.

It is desirable to use a switching diode which provides both a low insertion loss in the "ON" state and high isolation when in the "OFF" state. In selecting a diode for use in a switching power divider, diode characteristics which increase output port isolation also result in higher insertion losses, making a compromise in diode parameters necessary. Diode insertion loss and isolation figures are calculated from equations 1 and 2.

Equation 1:

$$\text{Insertion Loss } (dB) = 20 \log \left[ 1 + \frac{R_s}{2Z_0} \right]$$

Equation 2:

$$\text{Isolation } (dB = \log \left[ 1 + \left( \frac{1}{4\pi f C_j Z_0} \right)^2 \right]$$

where $R_s$=series resistance in ohms of the diode in the forward bias or "ON" state;

$Z_O$=the characteristic impedance in ohms of the tapered transmission line containing the diode at its outer radius $R_3$;

f=the operating frequency in Hz;

$C_j$=the diode junction capacitance (in farads) in the reverse bias (OFF) state;

For a fixed operating frequency f, minimal insertion loss and maximum isolation occur when $R_s$ and $C_j$ are at a minimum. For operation in the microwave S-band (approximately 2.0 to 2.3 GHz) practical values of $R_s$ and $C_j$ for state-of-the-art PIN diodes are $R_s$=2 ohms maximum and $C_j$=0.03 picofarads maximum. A PIN diode possessing these characteristics provides 0.8 dB insertion loss when switched "ON" and 13.5 dB isolation when switched "OFF".

The present invention presents an integrated approach toward providing a high speed and efficient switching power divider for microwave frequencies. For example, in a 120 output port switching power divider designed for use at a frequency of 2.15 GHz (FIGS. 1 and 3), up to 12 output ports can be switched "ON" with equal power division through each "ON" port. When the "ON" ports are symmetrically located about power distribution disk 23, the energy propagation along strip lines 25 is transferred with equal phase and amplitude to each of the selected output ports. In the worst-case situation when all 12 "ON" ports are located adjacent one another, output amplitude variation between output ports is approximately ±0.5 dB and phase variation is approximately ±10°.

A 120 port switching power divider constructed in accordance with the principles of the present invention may have the following dimensions and characteristics:

Frequency=2.15 GHz (wavelength=14 cm);

$R_1$ (radius of disk 23)=1.24 cm (0.09 wavelengths);

$R_2$ (radius of cavity 9)=8.45 cm (0.6 wavelengths);

$R_3$ (radius of transmission lines 25)=5.58 cm (0.4 wavelengths);

$R_4$ (radius of output ports 47)=6.1 cm (0.435 wavelengths);

H (height of cavity)=0.8 cm (0.057 wavelengths);

Thickness of dielectric substrate=0.13 mm;

Input VSWR (50 ohm reference)=1.5:1 maximum;

Power handling capability=up to 50 watts CW (continuous wave);

Insertion loss of "ON" ports=0.8 dB;

Isolation of "OFF" ports=13.5 dB;

DC bias power consumption with 12 ports "ON"=0.3 watt;

Output port impedance=50 ohms;

Output port amplitude variation=±0.5 dB;

Output port phase variation=±10°.

A 120 output port switching power divider constructed in accordance with the above dimensions has an overall assembled diameter of approximately 22 cm, a height of 3.3 cm and a weight of 865 grams.

A switching power divider constructed in accordance with the principles of the present invention is particularly useful as a microwave antenna switch in an earth orbiting satellite having a multi-element spherical antenna array because of its light weight, small size and low power consumption.

As shown in FIG. 6, a satellite 71 includes a number of microwave antenna elements 73 distributed over the spherical surface of the satellite. A 120 port switching power divider 75 is located within the interior of satellite 71. A wiring harness 77 connects coaxial output cables 55 from the output ports of switching power divider 75 to individual antenna elements 73. Normally, the number of antenna elements 73 is equal to the number of switchable output ports in switching power divider 75.

A conventional microprocessor or other source of switching current 79 supplies DC bias current to switching power divider 75. Microprocessor 79 selectively switches one or more of the switching diodes contained in switching power divider 75 to their "ON" state to couple a source of microwave energy (not shown) to selected antenna elements 73.

In the case of a 120 element spherical antenna array where elements 73 are nearly evenly distributed over the surface of satellite 71, arrays of up to 12 elements are simultaneously actuated and fed power from switching power divider 75. With this arrangement, up to 512 beam combinations are possible. Narrow beams (small solid angles) having up to 14 decibels gain can be formed in virtually any direction (90% spherical coverage). Multi-beam patterns (approximately 8 decibels gain) and an omni-directional pattern (−3 decibels gain) can also be formed by suitable actuation of up to 12 of the antenna elements.

The switching power divider of the present invention can also be used to couple selected antenna elements of a multi-element antenna array to a microwave utilizer 39, as shown in FIG. 2.

Thus a switching power divider constructed in accordance with the principles of the present invention is desirably light in weight, small in size, and consumes little power during operation. Integrated microwave distribution switching circuitry is formed on both sides of a thin dielectric substrate suspended midway between a pair of ground planes. The ground planes are short circuited at their periphery to form a microwave cavity. A TEM radial line mode is excited within the power divider cavity and is efficiently coupled to the impedance matching microwave strip line transmission circuits formed on the dielectric substrate. A source of switching current forward biases one or more selected high speed switching diodes to couple the propagating microwave energy to selected output ports. The output ports are connected to individual elements of a multi-element antenna array. A plurality of the output ports can be switched "ON" simultaneously to provide selected antenna beam patterns, with the microwave energy being transferred to the "ON" ports with substantially equal amplitude and phase.

The arrangement and selection of elements of the switching power divider results in low insertion losses for the "ON" output ports while providing desirably high microwave isolation characteristics for the "OFF" output ports. Output port impedance is selected by locating the output ports at a suitable radial distance within the cavity. Input-output impedance transformation is accomplished by forming each strip line-type transmission line with a taper having a radially increasing width.

While the switching power divider of the present invention has been described in considerable detail, it is understood that various changes and modifications would occur to persons of ordinary skill in the art without departing from the spirit and scope of the appended claims.

We claim:

1. A microwave switching, power divider for selectively dividing and switching microwave energy at wavelength λ among a plurality of outputs, comprising:

first and second parallel ground planes joined together by a short circuiting wall along a transverse plane radially interior of the outer perimeter of the ground planes and defining a discoid microwave cavity having an axial height substantially less than λ and an interior radius of less than λ;

a dielectric substrate disposed parallel to and spaced apart between said first and second ground planes within said cavity, said dielectric substrate including microwave power distribution and switching circuits, said circuits comprising:

a central microwave power distribution element disposed about the center of said substrate and connectable to a source of microwave power;

a plurality of power dividing transmission lines lying wholly within said cavity connected to and radially disposed about said distribution element;

an equal plurality of output ports spaced substantially less than λ inward from said short circuiting wall, a different one of said ports disposed radially outward from and adjacent each of said radial transmission lines; and switching means interposed between the outermost extremity of each said transmission line and each said output port for selectively controlling the coupling between the entireties of one or more of said transmission lines and said output ports.

2. The switch of claim 1 wherein said switching means comprises:

an equal plurality of diodes each connected to a different one of said transmission lines at the outermost extremity of each of said transmission lines; and an equal plurality of microwave blocking chokes each coupled to the distal end of a different one of said diodes and disposed radially outward from the respective transmission line and adjacent output port.

3. The switch of claim 1 including:

a central power input coaxial cable connected to said source of microwave energy, said input cable having a central conductor connected to said power distribution element and a shield connected to said first and second ground planes; and a plurality of power output coaxial cables each having a central conductor connected to one of said output ports and a shield connected to said first and second ground planes.

4. The switch of claim 1 wherein said radial transmission lines each comprise a tapered stripline having an increasing width as a function of radial distance from said distribution element.

5. The switch of claim 1 wherein said central microwave power distribution element comprises a conductive disk.

6. The switch of claim 1 wherein said central microwave power distribution element is connected to a utilizer of microwave energy.

7. A microwave power divider for selectively dividing and switching microwave energy of wavelength λ among a plurality of antenna elements, comprising:

first and second parallel ground planes shortcircuited along an inner circumference, defining a discoid microwave cavity having an axial height of between 0.05 and 0.1λ, a planar dielectric substrate spaced apart between and parallel to said first and second ground planes within and occupying less than five percent of volume of said cavity, said dielectric substrate including microwave power and switching circuits formed on at least one side of said substrate, said circuits comprising:

a central microwave power distribution element disposed about the center of said substrate and connectable to a source of microwave energy;

a plurality of power dividing transmission lines lying wholly within said cavity connected to and symmetrically disposed radially about said distribution element, the number of said transmission lines being at least equal to the total number of antenna elements to be switched;

an equal plurality of output ports equidistantly spaced radially inward from said circumference by a distance of between 0.15 and 0.2λ, inclusive, a different one of said ports disposed adjacent and radially outward from a different one of said radial transmission lines; and an equal plurality of switching means each interposed between a different one of said transmission lines and an adjacent one of said output ports for selectively coupling one or more of said radial transmission lines to corresponding adjacent output ports.

8. The switch of claims 1 or 7 wherein said switching means comprises:

an equal plurality of high-speed switching diodes and DC blocking capacitors connected in series between an outer extremity of each said radial transmission line and the respective one of said adjacent output ports; and an equal plurality of high impedance microwave blocking chokes connected in series with each transmission line via said switching diodes and a source of switching current.

9. The switch of claim 8 wherein each of said microwave blocking chokes comprises:

a quarter-wavelength meander line connected between one of said switching diodes and said source of switching current; and a quarter-wavelength conductive stub connected to said source of switching current and said meander line and extending radially outward from said meander line co-radially with a respective one of said transmission lines.

10. A microwave switching power divider for selectively dividing and switching energy at wavelength λ among a plurality of outputs, comprising:

first and second parallel circular ground planes joined along an inner circumference, defining a discoid, air loaded microwave cavity having an axial height of between 0.05 and 0.1λ;

a circular planar dielectric substrate spaced apart midway between and parallel to said first and second ground planes within and occupying less than five percent by volume of said cavity, said substrate having a radius equal to that of said cavity and less than λ, said dielectric substrate including identical microwave power distribution and switching circuits formed on opposite sides thereof, each of said circuits including:

a conductive disk symmetrically disposed about the center of rotation of said dielectric substrate connectable to a source of microwave energy;

a plurality of tapered power dividing striplines lying wholly within said cavity, symmetrically disposed radially about and connected to said conductive disk, each of said striplines having an increasing width as a function of radial distance from said conductive disk;

an equal plurality of output ports equidistantly disposed radially outward adjacent different of said radial striplines and radially inward from said circumference by a distance of between 0.15 and 0.2λ inclusive;

an equal plurality of diode switching means each interposed between the outmost part of different of said striplines and the respective adjacent output port for selectively coupling one or more of said radial stripline to said output ports; and an equal plurality of microwave blocking chokes each coupled to the outward end of a different one of said diodes and disposed radially outward from the respective transmission line and adjacent output port;

whereby output impedances for both striplines selectively coupled to output ports and striplines not selectively coupled to output ports are transformed back to said conductive disk with nearly equal transformation ratios.

11. The switch of claim 10 wherein each of said microwave blocking chokes comprises:

a quarter-wavelength meander line connected between one of said diode switching means and a source of switching current; and a quarter-wavelength conductive stub connected to said source of switching current and said meander line and extending radially outward from said meander line co-radially with a respective one of said striplines.

12. The switch of claim 10 wherein said conductive disk is connected to a utilizer of microwave energy.

13. The switch of claim 10 including:

a central power input coaxial cable connected to said source of microwave energy, said input cable having a central conductor connected to said conductive disk and a shield connected to said first and second ground planes; and a plurality of power output coaxial cables each having a central conductor connected to one of said output ports and a shield connected to said first and second ground planes.

14. The switch of claim 13 wherein each of said output cables is connected to a different antenna element of a multi-element antenna array.

* * * * *